United States Patent [19]

Bowers

[11] 4,149,342

[45] Apr. 17, 1979

[54] WINDOW GUARD

[76] Inventor: William O. Bowers, 4516 Main St., Adamsville, Ala. 35005

[21] Appl. No.: 877,257

[22] Filed: Feb. 13, 1978

[51] Int. Cl.[2] ..... E06B 3/68

[52] U.S. Cl. ..... 49/55; 49/57

[58] Field of Search ..... 49/55, 57

[56] References Cited

U.S. PATENT DOCUMENTS

| | | | |
|---|---|---|---|
| 446,480 | 2/1891 | Stebbins | 49/55 X |
| 980,535 | 1/1911 | Kleinegger | 49/57 |
| 2,584,706 | 2/1952 | Hulsey, Jr. | 49/55 |
| 3,163,205 | 12/1964 | Gottlieb | 49/55 X |
| 3,216,482 | 11/1965 | Lindholm | 49/55 X |

*Primary Examiner*—Kenneth Downey

*Attorney, Agent, or Firm*—Woodford R. Thompson, Jr.

[57] ABSTRACT

A pair of movable frame sections of a window guard are adapted for horizontal movement selectively to an inner retracted position and an outer extended position. Actuator means is operatively connected to the frame sections for moving the frame sections selectively to retracted position and extended position. Projections are carried by outer portions of the movable frame sections in position to penetrate adjacent frame members of a window opening upon movement of the frame sections to extended position.

4 Claims, 4 Drawing Figures

FIG. 4
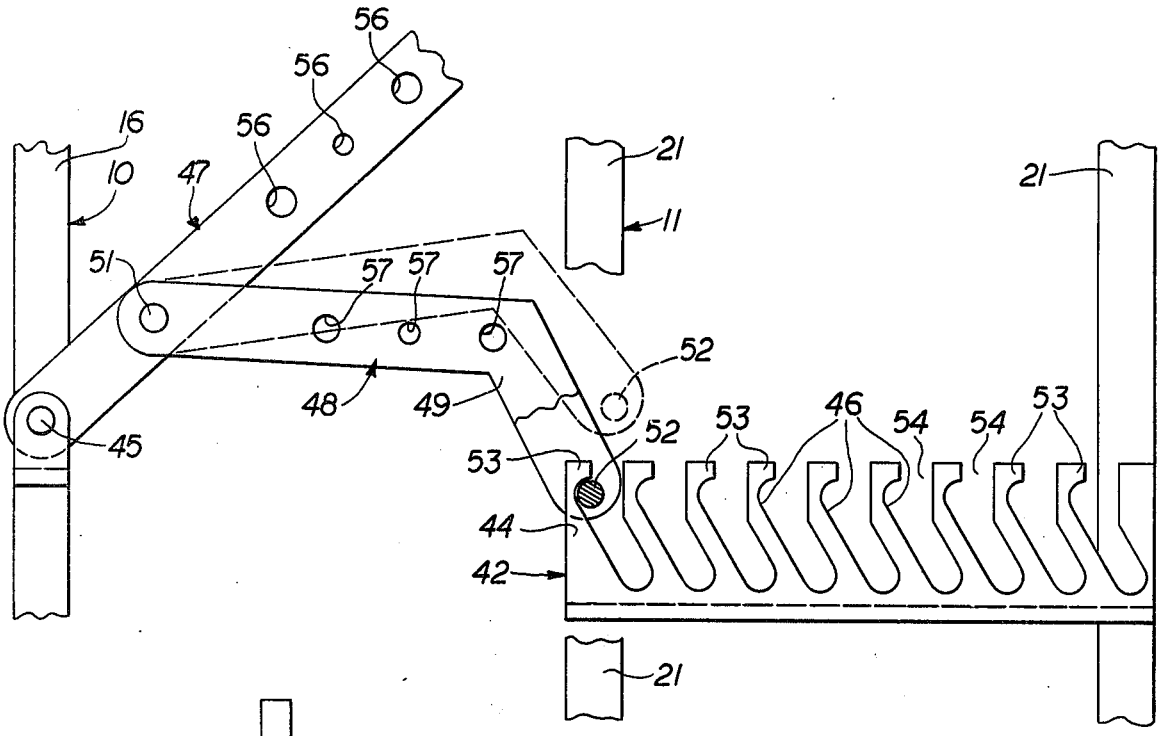
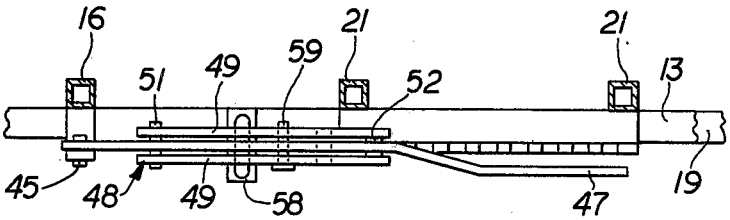
FIG. 2
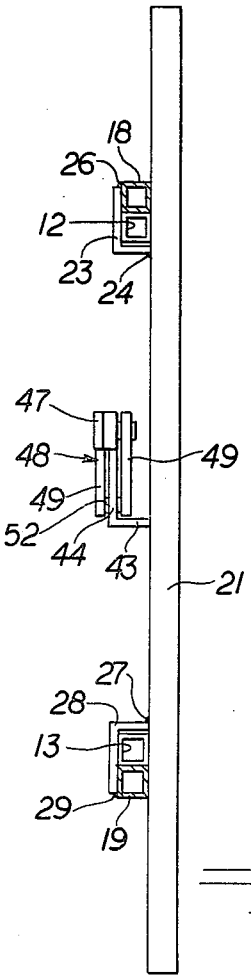
FIG. 3

WINDOW GUARD

BACKGROUND OF THE INVENTION

This invention relates to a window guard and more particularly to a window guard which is adjustable in width whereby it is adapted to fit window openings of various sizes and also includes improved means for easily and quickly removing the window guard from the window opening in the event of fire or other emergency conditions.

As is well known in the art to which my invention relates, difficulties have been encountered in providing window guards which are safe to use due to the fact that prior art window guards are very difficult to remove from the window opening in the event it is necessary for an occupant of a building to leave the building under emergency conditions. This is especially true in view of the fact that difficulties have been encountered in providing a window guard which is adjustable in width to accommodate window openings of various sizes without having to provide additional anchor means alongside the window opening.

Prior art window guards with which I am familiar are disclosed in the following patents: Kleinegger, U.S. Pat. No. 980,535; Kuenzel, U.S. Pat. No. 377,624; Shapiro, U.S. Pat. No. 2,589,878; and, Ryan, U.S. Pat. No. 560,937.

BRIEF SUMMARY OF THE INVENTION

To overcome the above and other difficulties, I provide a window guard which comprises a pair of movable frame sections which are adapted for horizontal movement selectively to an inner retracted position and to an outer extended position. Improved actuator means is interposed between the movable frame sections for moving the frame sections selectively to the retracted position and the extended position. The actuator means also includes means for varying the distance that the frame sections move relative to each other when the actuator means is operated whereby the window guard may be readily installed or removed by merely operating the actuator means. Projections are carried by outer portions of the movable frames in position to penetrate adjacent frame members of a window opening upon movement of the frame members to the extended position. Accordingly, no additional anchor means is required alongside the window opening.

DESCRIPTION OF THE DRAWINGS

A window guard embodying features of my invention is illustrated in the accompanying drawings, forming a part of this application, in which:

FIG. 2 is a sectional view taken generally along the line 2—2 of FIG. 1;

FIG. 3 is a sectional view taken generally along the line 3—3 of FIG. 1; and,

FIG. 4 is an enlarged, fragmental view showing the actuator means unlocked and in position to move the frame sections inwardly toward retracted position.

DETAILED DESCRIPTION

Figure 1:
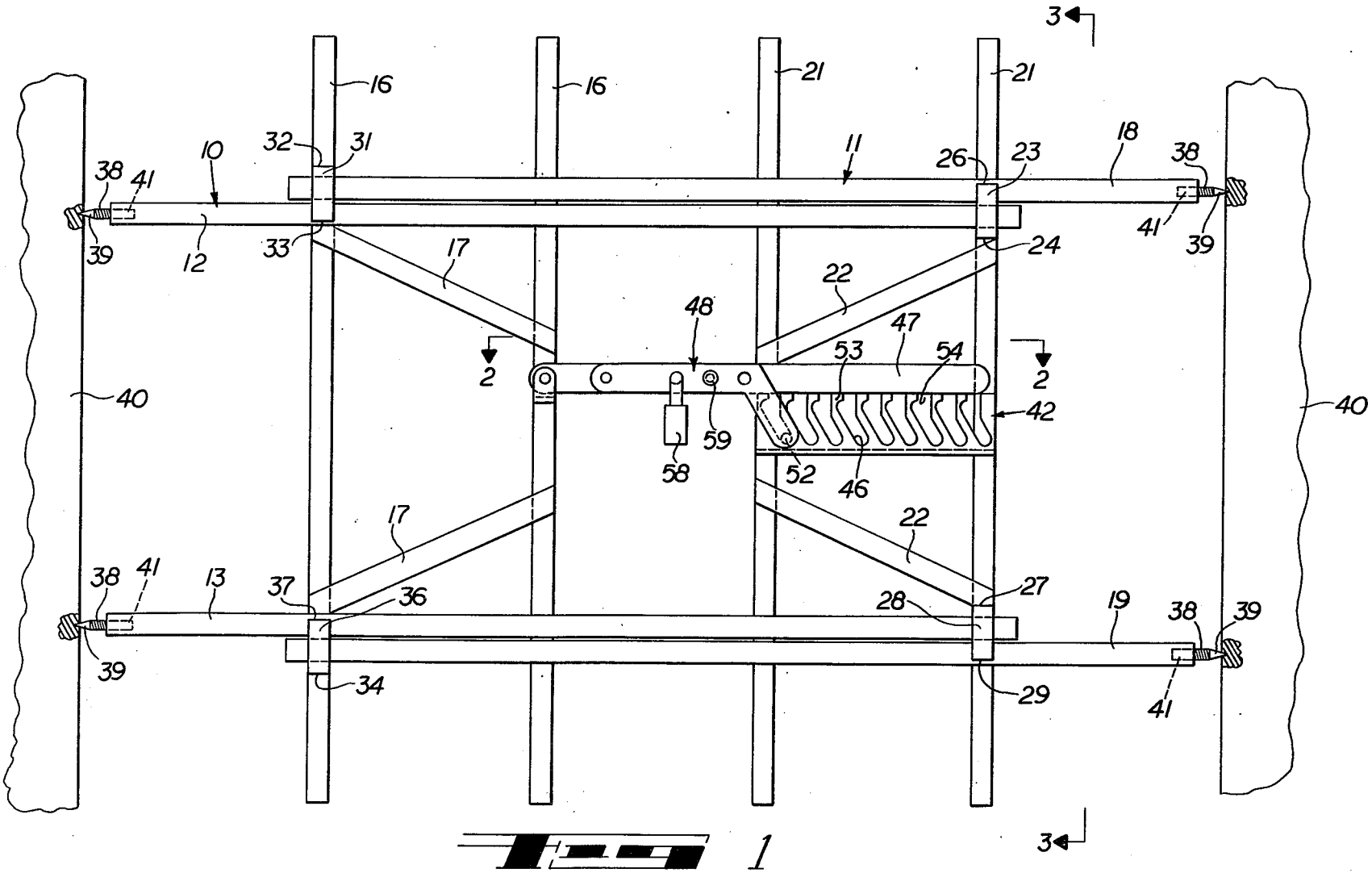
FIG. 1 is a side elevational view showing my improved window guard mounted within a window opening with the actuator means in locked position.

Referring now to the drawings for a better understanding of my invention, I show a pair of movable frame sections 10 and 11. The frame section 10 comprises horizontal bars 12 and 13 which are secured rigidly to vertical bars 16, by suitable means, such as by welding. To add further rigidity to the frame section 10, diagonal brace members 17 are secured rigidly to the vertical bar 16 as shown. The frame section 11 comprises horizontal bars 18 and 19 which are secured rigidly to vertical bars 21. Also, diagonal brace members 22 are secured to the vertical bars 21, as shown.

As shown in FIGS. 1 and 3, an L-shaped bracket 23 is secured to one vertical bar 21 adjacent the lower surface of the horizontal bar 12 as at 24. As shown in FIG. 3, the L-shaped bracket 23 is provided with an upstanding leg which extends alongside both bars 12 and 18 with the upper end of the bracket 23 being secured rigidly to the horizontal bar 18 as at 26. With the bracket 23 thus secured to the vertical bar 21 and the horizontal bar 18, the horizontal bar 12 is adapted for free sliding movement in the space defined between the bar 18, bar 21 and the bracket 23. Secured to one vertical bar 21, by suitable means, such as by welding 27, is a depending, L-shaped bracket 28 which extends downwardly alongside the outer surface of the horizontal bars 13 and 19. The lower end of the L-shaped bracket 28 is secured to the horizontal bar 19 as at 29 whereby the horizontal bar 13 is adapted for free sliding movement in the space defined between the bar 21, bar 19 and the bracket 28.

As shown in FIG. 1, a depending, L-shaped bracket 31 is secured to the outermost vertical bar 16 adjacent and above the upper surface of the horizontal bar 18 by suitable means, such as by welding at 32. The bracket 31 extends downwardly alongside the outer surfaces of the horizontal bars 18 and 12 with the lower end of bracket 31 being secured rigidly to the horizontal bar 12, such as by welding at 33. Accordingly, the horizontal bar 18 is adapted for free sliding movement relative to the bracket 31. Secured to the outermost vertical bar 16 adjacent the under surface of the horizontal bar 19, by welding at 34, is an upstanding L-shaped bracket 36 which extends upwardly alongside the outer surface of the horizontal bars 13 and 19 with the upper end of the bracket 36 being welded to the horizontal bar 13 as at 37. It will thus be seen that the movable frame sections 10 and 11 are adapted for free horizontal movement relative to each other. That is, the frame section 10 comprising the horizontal bars 12 and 13 and the vertical bars 16 is mounted in sliding engagement with the movable frame section 11 comprising the horizontal bars 18 and 19 and the vertical bars 21.

Mounted at each end of each of the horizontal bars 12, 13, 18 and 19 is a horizontally extending projection 38 having a pointed outer end 39 which is adapted to penetrate an adjacent vertical frame member 40 of a window opening. That is, as the movable frame sections 10 and 11 move from an inner collapsed position toward an outer extended position, the projections 38 are moved toward the vertical frame members 40 whereby the pointed ends 39 of the projection 38 penetrate the frame member 40 to thus secure the window guard unit in place without the necessity of having to provide additional securing elements along the vertical frame member 40. As shown in FIG. 1, the horizontally extending projections 38 are threaded externally and are in threaded engagement with threaded openings 41 provided in the ends of the rods 12, 13, 18 and 19. Accordingly, the effective length of each of the threaded projections 38 may be varied to accommodate windows of different shapes. That is, where the window opening is not square or the vertical side members 40 do not extend in a true vertical direction, the threaded projections 38 may be adjusted relative to their associated rods whereby all of the pointed ends 39 engage the adjacent vertical side members 40 at the same time.

To move the movable frame sections 10 and 11 selectively to an inner retracted position and to an outer extended position, I provide an actuator unit now to be described. Mounted rigidly between vertical rods 21 of the movable section 11 is a horizontal, angle bracket 42 having a horizontal leg 43 which is provided with upwardly opening, spaced apart slots 46 which slope upwardly toward the other movable frame section 10, as shown in FIG. 4. An elongated handle 47 is pivotally connected adjacent one end by a suitable pivot pin 45 to a vertical rod 16 of the movable frame section 10. As shown in FIG. 1, the handle 47 is of a length to extend along the inner side of the movable frame section 11. A link 48 comprising parallel members 49 is pivotally connected adjacent one end by a pivot pin 51 to the handle 47 intermediate the ends of the handle 47, as clearly shown in FIG. 4. The end of the parallel members 49 of the link 48 are turned downwardly, as shown in FIG. 4, to provide free ends which extend downwardly toward the horizontal bracket 42 whereby a member 49 extends along each side of the vertical leg 44 of the horizontal bracket 42 as shown in FIG. 3.

A lateral pin-like member 52 is carried by the free ends of the members 49 defining the link 48, as clearly shown in FIG. 4. Preferably, the pin-like member 53 extends between the depending ends of the members 49 and is secured rigidly thereto in position to enter selected ones of the upwardly opening slots 46 upon downward movement of the handle 47 to thus move the movable frame sections 10 and 11 relative to each other toward an outer, extended position, as shown in FIG. 1. A detent 53 is carried by the upper end of the lowermost side of each of the upwardly opening slots 46, as shown in FIG. 4. The detent is in position to engage the pin-like member 52 upon upward movement of the handle 47 to move the movable sections 10 and 11 inwardly relative to each other toward retracted position whereby the projections 38 move away from the vertical members 40 and out of the recesses formed therein whereby the window guard may be removed from the window opening. The detent 53 thus defines with the upper end of the uppermost side of each of the upwardly opening slots 46 an offset re-entry passageway 54 so that the pin-like member 52 is movable into and from the upwardly opening slot 46 when the link 48 is manually positioned to align the pin-like member 52 with the re-entry passageway 54.

To lock the movable frame sections 10 and 11 in the outer extended position, as shown in FIG. 1, the handle 47 is detachably locked to the link 48 while the handle is in its lowermost position. Longitudinally spaced openings 56 are provided in the handle 47 in position to move into alignment with longitudinally spaced openings 57 provided in the members 49 of the link 48 upon movement of the handle 47 to its lowermost position. A removable locking element, such as a padlock 58 or a pin-like member 59 are adapted to extend through selected ones of the aligned openings in the handle 47 and link 48.

From the foregoing description, the operation of my improved window guard will be readily understood. To install the window guard in a window opening, the lock 58 or pin 59, as the case may be, is removed from the aligned openings in the handle 47 and link 48 whereby the handle 47 is movable to the raised position, as shown in FIG. 4. Upon upward movement of the handle 47, the pin-like member 52 engages the detent 53 at the upper end of the slot 46 which carries the pin 52 whereby further movement of the handle 47 in an upward direction causes the frame sections 10 and 11 to move inwardly toward each other toward retracted position. The window guard is then positioned in the window opening and the link 48 is manually positioned in selected ones of the upwardly opening slots 46 whereby upon downward movement of the handle 47, the pin-like member 52 moves to the bottom of its slot 46 and then moves the frame sections 10 and 11 outwardly away from each other toward extended position. In the event the inner surfaces of the vertical members 40 are not in a true vertical position, the threaded members 38 may be adjusted by rotating the threaded members relative to the openings 41 in the horizontal rods 12, 13, 18 and 19 whereby all of the pointed ends 39 of the window guard engage the vertical members 40 at substantially the same time. Continued outward movement of the frame sections 10 and 11 relative to each other causes the pointed ends 39 of the threaded members to penetrate the adjacent vertical members 40 whereby the window guard is anchored firmly in the window opening. With the window guard thus anchored in place and the handle 47 in its lowest position, as shown in FIG. 1, the padlock 58 or locking pin 49 is inserted through selected ones of the openings in the handle and link to thus secure the window guard in place.

From the foregoing, it will be seen that I have devised an improved window guard. By providing improved means for detachably connecting the movable sections 10 and 11 to each other, together with the outwardly extending projections at the outermost ends of the movable frame sections, the window guard may be easily and quickly installed by manually moving the link 48 to position the pin-like member 52 in selected ones of the upwardly opening slots 46 and then pressing downwardly on the handle 47 whereby the frame sections 10 and 11 move outwardly to extended position. The pointed ends 39 of the threaded members 38 penetrate the vertical members 40 of the window opening whereby the window guard is anchored in place without providing additional anchor means along the window opening. Also, by providing detachable means for connecting the link 48 to the handle 47, the window guard may be easily and quickly removed by merely removing the pin 59 on the handle 47. Furthermore, by providing a plurality of longitudinally spaced slots 46 the window guard is adapted to accomodate window openings of various sizes by merely positioning the pin-like member 52 in selected ones of the upwardly opening slots 46.

While I have shown my invention in but one form, it will be obvious to those skilled in the art that it is not so limited, but is susceptible of various changes and modifications without departing from the spirit thereof.

I claim:

1. In a window guard adapted to be mounted in a window opening having vertical frame members at opposite sides thereof, (a) a pair of movable frame sections adapted for horizontal movement relative to each other selectively to an inner retracted position and to an outer extended position, (b) a bracket carried by one of said movable frame sections and having upwardly opening, horizontally spaced slots therein which slope upwardly toward the other movable frame section, (c) an elongated handle pivotally connected adjacent one end to said other movable frame section and being of a length to extend alongside said one movable frame section, (d) a link pivotally connected adjacent one end to said handle intermediate the ends of said handle and having a free end adapted to extend toward said bracket, (e) a lateral pin-like member carried by said free end of said link in position to enter selected ones of said upwardly opening slots in response to downward movement of said handle and said free end of said link to move said movable frame sections relative to each other toward said outer extended position, (f) a detent carried by the upper end of the lowermost side of each said upwardly opening slot extending laterally away from said other movable frame section in position to engage said pin-like member upon upward movement of said handle to positively move said movable sections inwardly relative to each other toward said retracted position, (g) means detachably locking said handle to said link with said handle in its lower position and said movable sections in said outer extended position, and (h) horizontally extending projections carried by outer portions of said movable frame sections adapted to penetrate said vertical frame members in response to movement of said movable frame sections to said outer extended position to secure the window guard in place and adapted to move out of engagement with said vertical frame members in response to movement of said movable sections to said inner retracted position.

2. A window guard as defined in claim 1 in which said detent defines with the upper end of the uppermost side of each said upwardly sloping slot an offset re-entry passageway so that said pin-like member is movable into and from said upwardly opening slot when said link is manually positioned to align said pin-like member with said re-entry passageway.

3. A window guard as defined in claim 1 in which said link comprises, elongated members extending along opposite sides of said handle and pivotally connected to said handle by a common pin, with the free ends of said elongated members extending downwardly at an angle in position to move along opposite sides of said horizontal bracket with said pin-like member extending between and secured to said free ends of said elongated members.

4. A window guard as defined in claim 1 in which said means detachably locking said handle to said link comprises longitudinally spaced openings in said link adapted to move into alignment with longitudinally spaced openings in said handle while said handle is in its lower position, and a removable lock element adapted to pass through selected aligned openings through said link and said handle.

* * * * *